US012172805B2

(12) United States Patent
Egorov et al.

(10) Patent No.: US 12,172,805 B2
(45) Date of Patent: Dec. 24, 2024

(54) DRINK BOTTLE

(71) Applicant: b.box for kids developments Pty Ltd, Mulgrave (AU)

(72) Inventors: Miroslav Egorov, Mulgrave (AU); Lisa Edlund Tjernberg, Mulgrave (AU); Sylvain Jacques Amatoury, Mulgrave (AU)

(73) Assignee: b.box for kids developments Pty Ltd, Notting Hill (AU)

( * ) Notice: Subject to any disclaimer, the term of this patent is extended or adjusted under 35 U.S.C. 154(b) by 408 days.

(21) Appl. No.: 17/609,471

(22) PCT Filed: May 30, 2019

(86) PCT No.: PCT/AU2019/050549
§ 371 (c)(1),
(2) Date: Nov. 8, 2021

(87) PCT Pub. No.: WO2020/227752
PCT Pub. Date: Nov. 19, 2020

(65) Prior Publication Data

US 2022/0212843 A1 Jul. 7, 2022

(30) Foreign Application Priority Data

May 13, 2019 (AU) ..... 2019203320

(51) Int. Cl.
*B65D 47/20* (2006.01)
*B65D 47/06* (2006.01)
*B65D 47/08* (2006.01)

(52) U.S. Cl.
CPC ..... *B65D 47/2043* (2013.01); *B65D 47/066* (2013.01); *B65D 47/0885* (2013.01); *B65D 2547/066* (2013.01)

(58) Field of Classification Search
CPC ..... B65D 47/2043; B65D 47/066; B65D 47/0885; B65D 2547/066; A45F 3/18
See application file for complete search history.

(56) References Cited

U.S. PATENT DOCUMENTS 5,203,468 A 4/1993 Hsu
5,282,541 A 2/1994 Chen
(Continued)

FOREIGN PATENT DOCUMENTS

CN 201268441 Y 7/2009
CN 101648618 A 2/2010
(Continued)

*Primary Examiner* — Nathan J Jenness
*Assistant Examiner* — Jennifer Castriotta
(74) *Attorney, Agent, or Firm* — Young Basile Hanlon & MacFarlane, P.C.

(57) ABSTRACT

A drink bottle comprises a container and a lid. The lid is removably connected to an open end of the container. A resiliently flexible drinking spout or straw assembly is mounted in the lid. An actuator for actuating a function of the drink bottle is slidably mounted to the lid for sliding movement between a home position and an actuation position. The actuator has a push face accessible from outside the lid for receiving finger pressure for displacing the actuator from the home position toward the actuation position for performing a function of the drink bottle. The actuator has a bearing surface in bearing engagement with the spout or straw assembly such that movement of the actuator from the home position towards the actuation position resiliently deforms the spout or straw assembly and by the resilient deformation the actuator is biased towards the home position.

21 Claims, 5 Drawing Sheets

(56) References Cited

U.S. PATENT DOCUMENTS

| | | | | |
|---|---|---|---|---|
| 6,279,773 | B1 | 8/2001 | Kiyota | |
| 8,550,269 | B2 | 10/2013 | Lane | |
| 8,622,229 | B2 | 1/2014 | Lane | |
| 8,985,370 | B2 | 3/2015 | Lane | |
| 9,079,205 | B2 | 7/2015 | Hoskins | |
| 9,380,898 | B2 * | 7/2016 | Mason | A47G 19/2272 |
| 9,585,803 | B2 | 3/2017 | Niedens | |
| 9,675,191 | B2 | 6/2017 | Kurabe et al. | |
| 2012/0312832 | A1 | 12/2012 | Lane | |
| 2013/0319966 | A1 | 12/2013 | Lane | |
| 2014/0061248 | A1 | 3/2014 | Hoskins | |
| 2014/0175042 | A1 | 6/2014 | Lane | |
| 2015/0164254 | A1 | 6/2015 | Niedens | |
| 2015/0282654 | A1 | 10/2015 | Kurabe et al. | |

FOREIGN PATENT DOCUMENTS

| | | | |
|---|---|---|---|
| CN | 101648618 | B | 3/2012 |
| CN | 102482010 | A | 5/2012 |
| CN | 202723379 | U | 2/2013 |
| CN | 103224086 | A | 7/2013 |
| CN | 203662440 | U | 6/2014 |
| CN | 104973324 | A | 10/2015 |
| CN | 107284836 | A | 10/2017 |
| CN | 207461878 | U | 6/2018 |
| CN | 109480570 | A | 3/2019 |
| CN | 208582133 | U | 3/2019 |
| CN | 209547697 | U | 10/2019 |
| EP | 2532601 | A1 | 12/2012 |
| JP | H09-058729 | A | 3/1997 |
| JP | 2000238821 | A | 9/2000 |
| JP | 2000335616 | A | 12/2000 |
| JP | 2002173162 | A | 6/2002 |
| JP | 2010241461 | A | 10/2010 |
| JP | 5148544 | B2 | 2/2013 |
| WO | 2018201654 | A1 | 11/2018 |

* cited by examiner

DRINK BOTTLE

PRIORITY CROSS-REFERENCE

This application is a national stage 371 application of PCT/AU2019/050549, filed on May 30, 2019, which claims priority to Australian Patent Application No. 2019203320, filed May 13, 2019, the contents of which are incorporated into this specification by this reference.

TECHNICAL FIELD

The present invention relates to a drink bottle that has a drink container portion and a lid that removably connects to an open end of the container portion. The present invention is particularly concerned with drink bottles that employ a flexible drinking spout or straw that extends through the lid and into the container portion to facilitate drinking from the drink bottle. The present invention also relates to a removable lid for a drink bottle.

The present invention has particular application to drink bottle lids that are formed in two parts which have a first portion or inner lid that is connectable to the open end of a container portion and a second portion or outer lid that is hingedly connected to the first portion. In these forms of drink bottle lids, the outer lid can be hinged between an open position in which the drinking spout or straw is exposed for use, and a closed position in which the outer lid closes over the inner lid so that the drinking spout or straw becomes inaccessible and flow through the spout or straw is prevented. It will be convenient to describe the background to the invention in relation to this form of drink bottle.

BACKGROUND OF INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

U.S. Pat. No. 8,622,229 in the name of Thermos LLC discloses a drink bottle with a removable lid that has inner and outer lids that are hinged to each other. A flexible drinking spout extends through the inner lid and also through an opening in a slide within the inner lid. The slide can be shifted between a first position in which a leading end of the slide cooperates with the outer lid to maintain the outer lid in a closed position relative to inner lid, and a second position in which the slide is retracted to release the leading end from cooperation with the outer lid so that the outer lid can pivot relative to the inner lid to an open positon, thereby providing access to the drinking spout.

A surface of the opening in the slide through which the drinking spout extends bears against a side surface of the drinking spout. That bearing engagement resists movement of the slide away from the first position and that resistance thus maintains the slide in the first position (absent a load overcoming the resistance) to maintain the cooperation between the leading end of the slide and the outer lid so as to maintain the outer lid in the closed position.

Retracting movement of the slide is resisted by resilient deformation of the flexible drinking spout. That resistance tends to return the slide from the second position to the first position when the load retracting the slide to the second position is released. Upon the load retracting the slide being released, the slide will return to the first position under resilient recovery of the drinking spout. In that position, the outer lid can be manually rotated to the closed position and the outer lid and the leading end of the slide will re-connect to retain the outer lid in the closed position.

The trailing end of the slide opposite the leading end is connected to a hinged button such that manual rotation of the button about the hinge in one direction retracts the slide from the first position against the resistance provided by resilient deformation of the drinking spout. Release of the button allows the button to rotate about the hinge in the opposite direction and to allow the slide to return under the influence of the drinking spout, to the first position.

The arrangement of U.S. Pat. No. 8,622,229 allows for quick release of the outer lid from the closed position for access to the drinking spout by pushing on the button to retract the slide. The arrangement of U.S. Pat. No. 8,622,229 further allows for automatic return of the slide from the retracted position so that when the outer lid is returned to the closed position, the leading end of the slide is in position for re-engaging the outer lid.

However, the arrangement of U.S. Pat. No. 8,622,229 is relatively complex, requiring a separate slide and button, and the button requiring separate connections to both the slide and the inner lid. The separate and hinged connection between the slide and the button is crucial to the operation of the drink bottle, as the hinge connection transfers the rotational force applied by a user to a lower portion of the button, to a linear force exerted onto the slide, to shift the slide in a direction to release the leading end of the slide from cooperation with the outer lid, thus releasing the outer lid to an open condition.

U.S. Pat. No. 8,550,269 in the name of Thermos LLC discloses an alternative drink bottle with a removable lid, in which the lid has an inner lid and an outer lid hinged to the inner lid. The inner lid has a button that extends through it and the button has a catch that cooperates with the outer lid to maintain the outer lid in a closed position relative to inner lid. The button can be shifted inwardly relative to the inner lid against the bias of a spring to release the catch and to allow the outer lid to pivot relative to the inner lid to an open positon, to thereby provide access to the drinking spout.

U.S. Pat. No. 8,550,269 is also relatively complex, requiring the inclusion of a resilient tube to bias the button.

The present applicant has endeavoured to develop a drink bottle having a removable lid that has inner and outer lids, in which the complexity of the lid is reduced without affecting the operation of the lid. In doing so, the present applicant has developed a drink bottle having a mechanism that can perform as required for drink bottles having an inner and outer lid construction as described above, but which can also have alternative uses as will become evident from the discussion that follows.

SUMMARY OF INVENTION

According to the present invention there is provided a drink bottle comprising;

a. a container for containing a liquid and a removable lid,
b. the container having an open end and the lid being removably connected to the open end,
c. a resiliently flexible drinking spout or straw assembly being mounted in the lid for extraction of liquid from within the container through the spout or straw assembly,
d. an actuator for actuating a function of the drink bottle, the actuator being slidably mounted to the lid for sliding movement between a home position and an actuation position, the actuator having a push face accessible from outside the lid for receiving finger pressure for displacing the actuator from the home position toward the actuation position for performing a function of the drink bottle, e. the actuator having a bearing surface in bearing engagement with the spout or straw assembly such that movement of the actuator from the home position towards the actuation position resiliently deforms the spout or straw assembly and by the resilient deformation the actuator is biased towards the home position.

A drink bottle according to the invention can provide different functions depending on the use for which the actuator is put. In some forms of the invention, the drink bottle can include a removable lid that comprises an inner lid and an outer lid, with the outer lid being connected to the inner lid, such as being hingedly connected to the inner lid, to shift between closed and open positions or conditions. In these forms of the invention, the actuator can cooperate with the outer lid in the closed position of the outer lid to retain the outer lid in the closed position and movement of the actuator from the home position to the actuation position can release that cooperation so that the outer lid is released to shift to the open position. For this function, each of the actuator and the outer lid can, in some forms of the invention, include a catch so that the respective catches engage and cooperate when the outer lid is in the closed position to prevent movement of the outer lid to the open position. That is, the actuator and the outer lid each include catch components which engage and cooperate when the outer lid is in the closed position to prevent movement of the outer lid to the open position.

A drink bottle according to the above form of the invention in which the removable lid that comprises an inner lid and an outer lid, is relatively simple, at least compared to the prior art discussed above. The actuator can provide actuation as a single part, in contrast to the multi-part construction of the slider and button of U.S. Pat. No. 8,622,229, while there is no requirement for a resilient tube as disclosed in U.S. Pat. No. 8,550,269. With this latter prior art, applicant notes that standards around the world have requirements in relation to the use of small parts that could present choking hazards. The use of a small resilient tube in a drinking bottle could give rise to a breach of standards and present as a safety hazard.

Advantageously, the natural resilience of the spout or straw assembly can be employed for biasing the actuator towards or into the home position, so that an alternative bias arrangement (such as a coil spring or a resilient tube) is not required.

The simplicity of a drink bottle according to the above form of the invention allows for simplified manufacture and a reduction in parts, both of which contribute to a reduction in cost, although the operation of the drink bottle is still simple and effective.

However, development of the present invention has revealed that a slidable actuator that has a bearing surface in bearing engagement with the spout or straw assembly to bias the actuator towards the home position, can have other uses or functions in a drink bottle. For example, the slidable actuator can be used to prevent removal of the lid of a drink bottle by the actuator cooperating with the container of the drink bottle when the actuator is in the home position to lock the lid against disconnection from the container. In one example of this form of the invention, a portion of the actuator could extend into an opening in the container in the home position and by that cooperation between the actuator and the container, removal of the lid would be prevented. Where the lid connects to the container by screw thread, cooperation between the actuator and the container would be such as to prevent unthreading of the lid from the container. This could be a safety feature of a drink bottle according to the invention.

Alternatively, cooperation between the actuator and the container could be arranged to secure the lid to the container. That is, the lid could be applied to the container with the actuator in the actuation position and once the lid is in place on the container, the actuator could be released to the home position to move to a position of cooperation with the container and thus to secure the lid to the container. Removal of the lid from the container can be achieved by pushing the actuator from the home position to the actuation position to release the cooperation between the lid and the container. In this form of the invention, other forms of connection between the lid and the container, such as threaded connection, might not be required.

Still further, actuation of the actuator could be used to engage a vent to equalise the internal container pressure at any time, such as during drinking from the drink bottle, or in flight. In this form of the invention, a portion of the actuator could be in bearing contact with a vent flap, or could overlie a vent opening, such that movement of the actuator from the home position to the actuation position shifts the vent flap to an open or venting position, or exposes the vent opening to the interior of the container.

The actuator could alternatively provide a fidget for children that benefit from tactile interactions, such as neuro divergent children. The fidget could simply be the action of biased movement between the home and actuation positions.

Still further, the lid of a drink bottle according to the invention might itself define a container for storage of snacks, cutlery, or other items. The lid could thus include an inner lid and an outer lid similar to that described above whereby a containment area or volume is created between the inner and outer lids in the closed position of the outer lid relative to the inner lid for storage purposes. In this form of the invention, the actuator can lock the outer lid closed relative to the inner lid in the home position and can release the outer lid to an open positon in the actuation position.

It will thus be evident that the aspect of the invention that is common to all of the embodiments discussed above, is the provision of a slidable actuator that is slidable between home and actuation positions and which is biased towards the home position by bearing engagement with the resiliently flexible drinking spout or straw assembly. It is to be noted that the reference herein to spout or straw assembly or later herein just to spout is intended to cover an assembly that has any form of flexible conduit through which liquid can be extracted for drinking from the bottle and includes other conduits such as teats. The expression also covers other components that might be associated with a drinking spout or straw assembly, such as a gasket and a vent for example. Such an assembly might also include a flexible projection that is engaged by the bearing surface of the actuator rather than the actual conduit of the assembly through which liquid flows during drinking.

Further discussion will be given in relation to forms of the invention that include a removable lid that comprises an inner lid and an outer lid, with the outer lid being connected to the inner lid, for movement between closed and open positions or conditions.

In these forms of the invention, the actuator can be slidably mounted to the lid in any suitable manner. In some forms of the invention, the actuator can be mounted or accommodated within an opening in the inner lid and the push face presents at or through a side wall of the inner lid. That is, the opening is open at or opens through a side wall of the inner lid so that the push face is accessible at the side wall of the inner lid for finger pressure. A portion of the actuator comprising the bearing surface can extend out of the opening for bearing engagement with the spout or straw assembly.

The actuator can for example have a relatively linear or straight form, so that the actuator has the push face at one end and the bearing surface at an opposite end and whereby the actuator has a lengthwise axis between the push face and the bearing surface is mounted in the inner lid for linear movement along the lengthwise axis.

For mounting the actuator in the inner lid, the opening in the lid can be a close or snug fit about the actuator so that the actuator is guided within the opening between the home and actuation positions. Thus, there can be sliding contact between the actuator and facing internal surfaces of the opening as the actuator moves between the home and actuation positions. The biasing load applied to the actuator by the drinking spout or straw assembly must be sufficient to overcome the frictional load generated by this sliding contact.

The actuator can be arranged to cooperate with the opening to prevent rotation of the actuator within the opening. In some forms of the invention, the actuator can include rails, arms or bars for receipt within grooves, slots or channels formed in the internal surfaces of the opening, or the actuator can include grooves, slots or channels for receipt of rails, arms or bars formed as part of the opening. Alternatively, the actuator can be formed in an irregular shape or in a non-circular shape with the opening, or a portion of the opening formed to have the same irregular or non-circular shape to prevent rotation of the actuator within the opening.

As discussed above, where the removable lid of the drink bottle comprises an inner lid and an outer lid, the actuator can be arranged to cooperate with the outer lid to retain the outer lid in the closed position. Any suitable arrangement of cooperation between the actuator and the outer lid can be employed such as the catch arrangement discussed above.

The catch arrangement can be operable so that, with the actuator in the home position and being biased into that position by engagement with the drinking spout or straw assembly and with the outer lid in the open position, or at least not in the closed position, movement of the outer lid to the closed position will cause the catch of the outer lid to drive the actuator to shift towards the actuation position to allow the respective catches to move to an engagement position and thereafter, the actuator can return to the home position for engagement between the respective catches. At that point, the outer lid is retained in the closed position.

The catch arrangement can include an upstanding catch (relative to an upright standing condition of the drink bottle) that is formed as part of the actuator. The upstanding catch can be upstanding from an upper surface of the actuator. The upstanding catch can include a lateral catch member which interacts or cooperates with a corresponding catch receiver of the outer lid in the closed position of the outer lid. A catch receiver would comprise an opening or detent for receiving the catch member. One or each of the catch member and the catch receiver can have an inclined or sloping surface so that the respective members can ride past each other prior to the catch member being received within the catch receiver.

The catch arrangement could take many other different forms.

The actuator can further include one or more abutments for terminating travel of the actuator within the lid. The abutments are arranged or positioned for engagement with abutment surfaces of the lid so that when the actuator reaches the home position, further travel of the actuator is terminated. Likewise, further abutments can be arranged or positioned so that when the actuator reaches the actuation position, further is terminated. The provision of abutments to terminate travel of the actuator at each of the home position and the actuation position, confines the extent to which the actuator can travel, or confines the allowable stroke of travel, and allows the bearing surface of the actuator to remain in permanent or constant contact with the drinking spout or straw assembly for permanent or constant biasing of the actuator towards the home position.

While the preference is for the bearing surface of the actuator to remain in permanent or constant contact with the drinking spout or straw assembly in the home position, it is to be appreciated that the actuator might lose contact with the spout or straw assembly in the home position, say due to manufacturing tolerances, or just over time as the drink bottle components wear. Thus, what is important is that the actuator be biased by the spout or straw assembly as the actuator moves from the home position to the actuation position so that upon release of the force displacing the actuator towards the actuation position, the spout or straw assembly biases the actuator back to the home position.

In some forms of the invention, the actuator is provided with a pair of abutments which extend in different directions, preferably opposite directions, for engagement with different abutment surfaces of the lid. This arrangement is most relevant to the abutments that terminate travel of the actuator at the home position, as it has the advantage that if the drink bottle is dropped for example, or suffers a sudden impact, if one of the abutments of the actuator dislodges from the abutting surface, the other of the abutments will retain abutting engagement with the other abutment surface and so the actuator will retain its position in the home position. In this example, if only one abutment were provided and that abutment became dislodged from the abutting surface, the actuator may become completely free from the lid and perhaps become lost or damaged.

The actuator can have an abutment at our adjacent the push face. That abutment can take any suitable form and can for example be or include a lip that engages a facing surface of the lid when the actuator is in the actuation position. Where the actuator has an upstanding catch as described earlier, the upstanding catch can engage with a surface of the lid when the actuator is in the actuation position. This can be in addition to a lip that is provided adjacent the push face.

The applicant has developed actuators that have particular constructions that provides advantages in operation. In one form of actuator, the actuator has a push face as required and a depending body that has the bearing surface formed at a portion of the body remote from the push face. In another form of actuator, the actuator has a push face as required and has two depending components comprising a pair of legs that are spaced apart. The legs extend generally in the same direction and away from the push face. One or each of the legs can include a bearing surface for bearing engagement with the drinking spout or straw assembly. The bearing surface can be formed at an end of one of the legs or at the ends of each leg remote from the push face. The bearing surface formed by one of the legs or by each leg can be slightly curved convexly for increased surface engagement with the surface of the drinking spout or straw assembly. Where the bearing surface is formed at the ends of each leg, the bearing surface can be formed in two parts that are separated by a gap whereby the gap is formed by a spacing between the pair of legs. The legs can be symmetrical about a centre line between them. The legs can include abutments for abutting abutment surfaces of the lid when the actuator is in the home position to locate the actuator in the home position.

The actuator can alternatively have a push face as required and three depending components comprising a pair of side legs and an intermediate body. The body and the side legs extend generally in the same direction and away from the push face. The side legs can be symmetrical about the body, so that the body is central between the side legs, although that is not essential.

In the above form of actuator, the body can include the bearing surface for bearing engagement with the drinking spout or straw assembly. The bearing surface can be formed at an end of the body remote from the push face. The bearing surface can be slightly curved convexly for increased surface engagement with the surface of the drinking spout or straw assembly. The side legs can be spaced from the body and the side legs can include abutments for abutting abutment surfaces of the lid when the actuator is in the home position to locate the actuator in the home position.

In each of the above arrangements, the legs can be arranged for flexing movement so that when the actuator is inserted into the lid, the legs flex inwardly from a relaxed or resting position to allow insertion and once inserted, the legs return to the relaxed or resting position with the abutments of the legs in abutting engagement with the abutment surfaces of the lid and the bearing surface of the legs or the body in bearing engagement with the spout or straw assembly. The spout or straw assembly thus biases the actuator towards the home position and thus biases the abutments of the legs into abutting engagement with the abutment surfaces of the lid. This form of actuator can include a catch arrangement of the kinds discussed above.

In the above forms of actuator, the legs can be captured at least partially in grooves, slots or channels formed in the internal surfaces of the lid, such as in an opening formed in the lid to receive the actuator, to guide the actuator during sliding travel between the home and actuation positions.

The drinking spout or straw assembly can have a drinking portion that extends from the inner lid and from which a person can drink, and which is captured between the inner and outer lids when the outer lid is in the closed position. That drinking portion of the spout or straw assembly can be collapsed in the closed position of the outer lid and upon release of the outer lid the resilient flexibility of the drinking portion can be operable to drive or shift the outer lid to the open position once it is released from the closed position by actuation of the actuator. The outer lid can spring to the open position as a result of resilient recovery of the drinking portion from the collapsed condition.

The above discussion illustrates the use of an actuator that has a bearing surface in bearing engagement with the spout or straw assembly of a drink bottle and the manner in which that arrangement can be employed in the opening and closing of a drink bottle lid that has both an inner lid and an outer lid. It is to be appreciated however that the invention can have other applications such as described above in relation to securing the lid (of any form) to the container of a drink bottle, venting a drink bottle, acting as a fidget, and forming part of a closure mechanism for a container that is formed as part of the drink bottle lid.

It should also be appreciated that the reference to liquid in this specification is intended to include low and high viscosity drinkable liquids that can be sucked through a straw or spout.

BRIEF DESCRIPTION OF DRAWINGS

In order that the invention may be more fully understood, some embodiments will now be described with reference to the figures in which.

DETAILED DESCRIPTION

Figure 3:
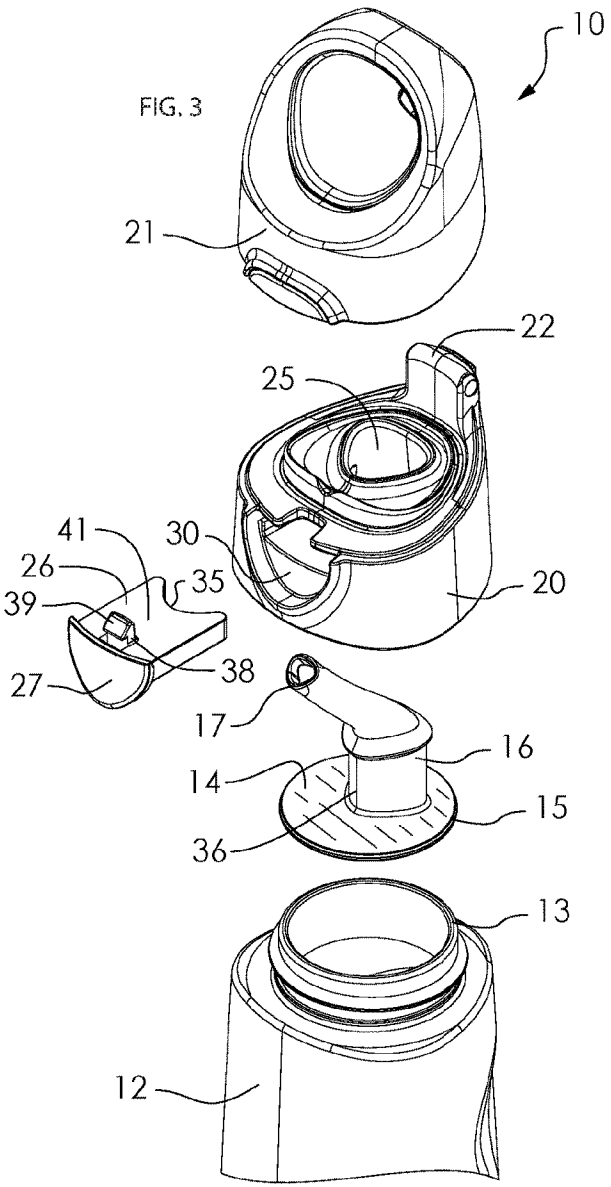
FIG. 3 is an exploded view of the drink bottle of FIGS. 1 and 2.
Figure 2:
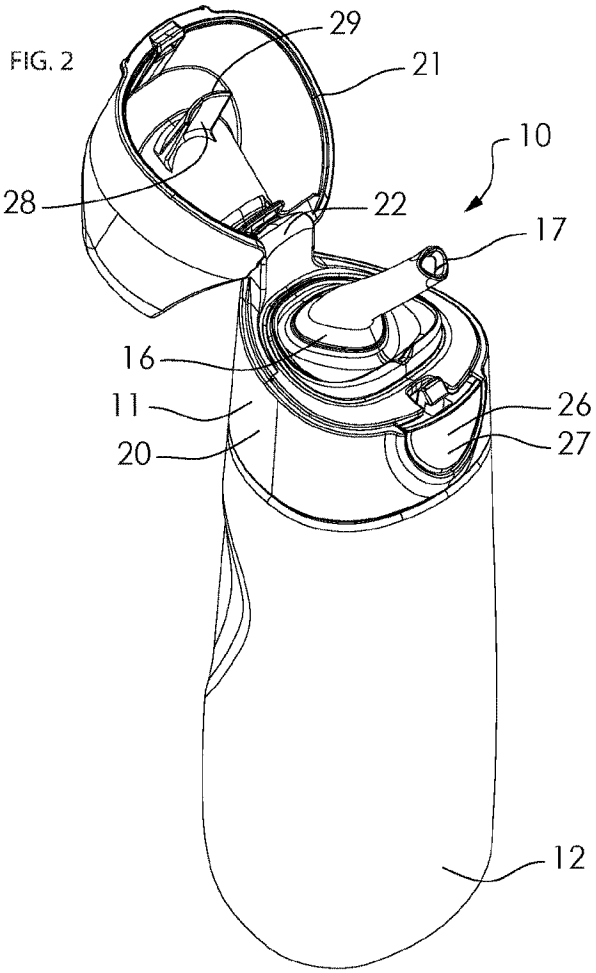
FIG. 2 is a perspective view of the drink bottle of FIG. 1 with the lid of the drink bottle in an open position.
Figure 1:
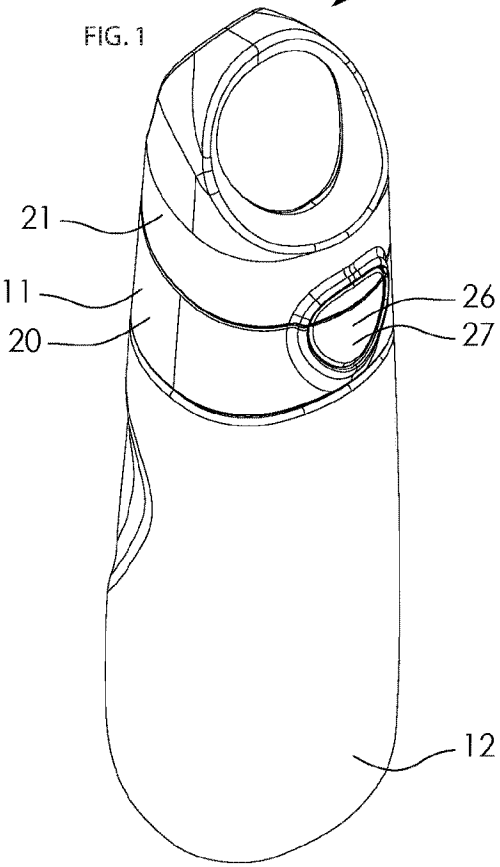
FIG. 1 is a perspective view of a drink bottle according to one embodiment of the invention with the lid of the drink bottle in a closed position.

FIGS. 1 and 2 illustrate perspective view of a drink bottle 10 according to one embodiment of the present invention. The drink bottle 10 is shown in FIG. 1 with the lid 11 of the bottle 10 in a closed condition and in FIG. 2 with the lid 11 in an open condition. FIG. 3 illustrates the drink bottle 10 in exploded view.

The drink bottle 10 includes a container 12 that in use will contain a quantity of fluid for drinking purposes. As shown in FIG. 3, the container 12 has an open end 13 and the lid 11 is removably connected to the open end 13 by a screw threaded arrangement. Inserted between the lid 11 and the open end 13 is a resiliently flexible drinking spout or straw assembly 14 (hereafter "drinking spout") which includes a circular gasket 15, a hollow neck 16 and a hollow drinking portion 17. The gasket 15 is sandwiched between facing sealing surfaces of the open end 13 and the lid 11, to provide a liquid seal between the container 12 and the lid 11 when the drink bottle 10 is assembled. This ensures that liquid that travels from the container 12 to the lid 11 passes through the neck 16 and into the drinking portion 17 without leakage.

The lid 11 includes an inner lid 20 and an outer lid 21. The respective inner and outer lids 20 and 21 are connected by a hinged connection 22.

The inner lid 20 includes an opening 25 for accepting and seating the neck 16 of the drinking spout 14. The resilient flexibility of the spout 14 means that the spout 14 can be assembled to the inner lid 20 by being pushed through and into engagement within the opening 25 and this secures the spout 14 in place in relation to the inner lid 20. Thus, the neck 16 is a tight fit within the opening 25 and the respective shapes of the opening 25 and the neck 16 are complementary.

As shown in FIG. 2, the outer lid 21 can pivot about the hinge 22 to the open position shown in FIG. 2 and can likewise return to the closed position shown in FIG. 1. As will be described later herein, the outer lid 21 can be retained in the closed position of FIG. 1 by a suitable catch mechanism that is associated with an actuator 26 (see FIG. 3). The actuator 26 is mounted within the inner lid 20 for sliding movement between a home position shown in FIGS. 1 and 2 and an actuation position (which will be described later herein). In the home position, the actuator 26 can secure the outer lid 21 in the closed condition relative to the inner lid 20 as shown in FIG. 1, while inward movement of the actuator 26 to the actuation position releases the outer lid 21 to shift to the open condition shown in FIG. 2. To shift between the home and actuation positions, the actuator 26 includes a push face 27 that can be pushed by finger pressure inwardly from the home position shown in FIGS. 1 and 2.

As will become apparent later herein, the drinking portion 17 is captured in a void between the inner and outer lids 20 and 21 when the lid 11 is in the closed position of FIG. 1. However, when the outer lid 21 is released from retention to the inner lid 20 (so that it is not retained in the closed position) by inward movement of the actuator 26, the resilient flexibility of the drinking portion 17 can be used to lift or drive the outer lid 21 to rotate about the hinge 22 to the open condition shown in FIG. 2. The resilience of the drinking portion 17 can be such as to spring the outer lid 21 open once the actuator 26 releases the outer lid 21 so that manual pivoting of the outer lid 21 to the open position is not required.

When the outer lid 21 rotates in the opposite direction from the open position to the closed position, the outer lid 21 will collapse the drinking portion 17 and for this, the outer lid 21 includes an internal post 28 to engage and push on the drinking portion 17. The free end 29 of the post 28 is curved convexly, tending to locate the drinking portion 17 centrally as it collapses and to resist the portion 17 from sliding out of engagement with the free end 29.

An important aspect of the drink bottle 10, is that the actuator 26 engages directly with a surface of the neck 16 of the drinking spout 14 in each of the open and closed conditions of the lid 11, and by that permanent or constant contact or engagement, the actuator 26 is permanently or constantly biased towards the home position of FIGS. 1 and 2. Moreover, inward sliding movement of the actuator 26 is resisted by that engagement and the bias applied to the actuator 26 tends to return the actuator 26 to the home position. Thus, finger pressure applied to the push face 27 can displace the actuator 26 inwardly of the inner lid 20, but once that pressure is released, the actuator 26 will return to the original position (the home position) from which the actuator 26 was initially pushed or displaced. As discussed earlier, this arrangement is relatively simple when compared to prior art arrangements, in that there is no requirement in the drink bottle 10 for a separate spring part to act on the actuator 26, and the actuator 26 is not formed from a pair of separate components that are connected together for pivoting movement.

Figure 6:
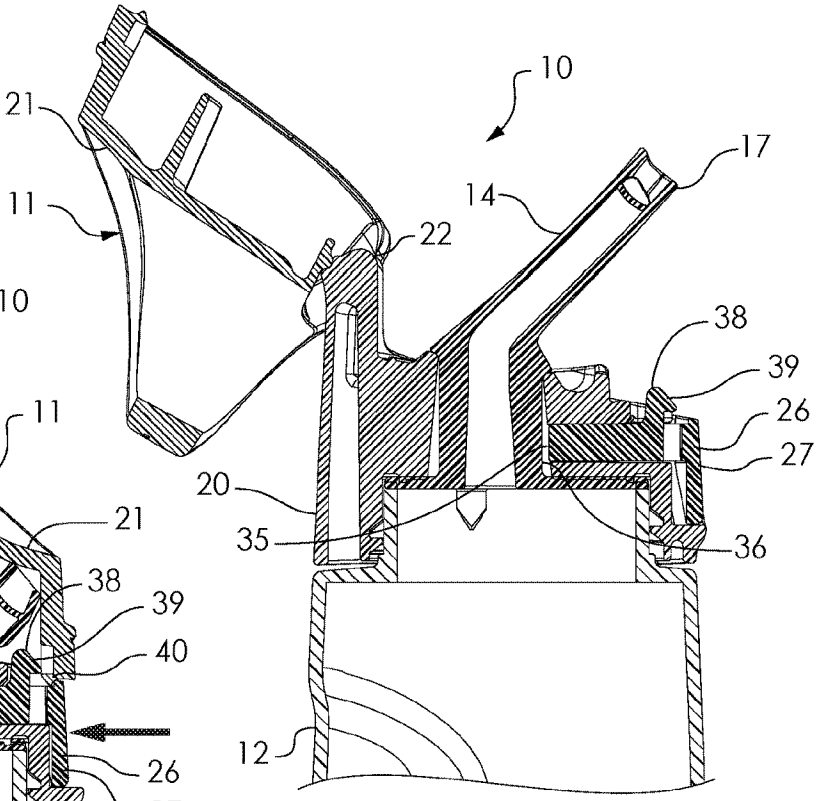
FIG. 6 is a cross-sectional view of the lid of the earlier figures, with the outer lid having shifted from the closed position of FIGS. 4 and 5, to a partly open position.
Figure 5:
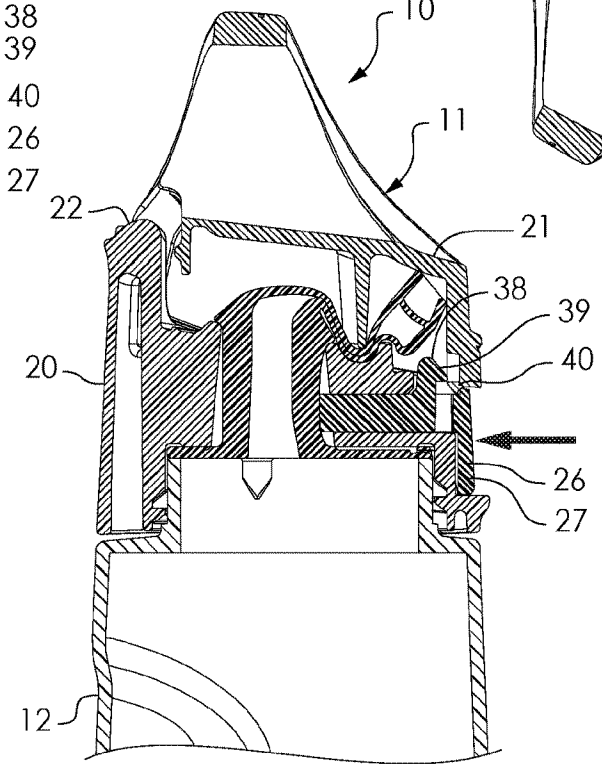
FIG. 5 is a cross-sectional view of the lid of the earlier figures, with the actuator shown in the actuation position.
Figure 4:
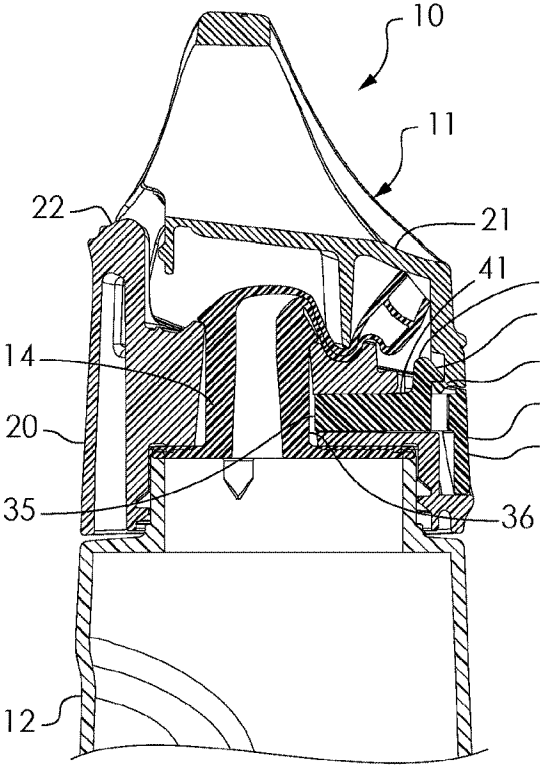
FIG. 4 is a cross-sectional view of the lid of the earlier figures, and showing the actuator in the home position.

The mechanism by which operation of the actuator 26 occurs is shown in more detail in FIGS. 4 to 6 which illustrates the lid 11 of the drink bottle 10 and only the upper portion of the container 12 which connects to the lid 11. FIGS. 4 and 5 show the lid 11 in a closed condition while FIG. 6 shows the lid 11 in an open condition. FIGS. 4 and 5 thus show the drinking portion 17 of the drinking spout 14 collapsed and captured in a void between the inner and outer lids 20 and 21.

The actuator 26 is slidably mounted within the inner lid 20 and so the actuator 26 remains with the inner lid 20 regardless of whether the outer lid 21 is in the closed or open position. FIGS. 4 to 6 show upper and lower surfaces of the opening within which the actuator 26 is captured. Side edges of the actuator 26 are captured in grooves, slots or channels formed in the lid 11. Thus, as shown in FIG. 3, the actuator 26 is received within the opening 30 of the inner lid 20 and the actuator 26 is mounted for sliding movement within that opening 30. The opening 30 is open at or through a side wall of the inner lid 21 so that the push face 27 is accessible for the application of finger pressure.

The end 35 of the actuator 26 forms a bearing surface for bearing engagement with a surface of the drinking spout 14. In FIG. 3, the surface of the spout 14 is the front surface 36 of the neck 16. As shown in FIG. 4, the bearing surface 35 of the actuator 26 faces the front surface 36 of the neck 16, but is slightly spaced from that surface. In FIG. 5, the actuator 26 has been shifted under finger pressure and thus has moved into contact with the surface 36. That contact is such as to resist inward movement of the actuator 26 within the opening 30.

FIG. 4 also shows that the actuator 26 includes an upstanding catch 38 that is upstanding from an upper surface of the body 41 of the actuator 26 as shown in the orientation of the drink bottle 10 and the lid 21 in the figures, and that includes a lateral catch member 39. Likewise, the outer lid 21 includes a catch receiver 40 and as shown in FIG. 4, the catch member 39 and the catch receiver 40 interact in the closed position of the outer lid 21 to retain the outer lid 21 in that position. The cooperating engagement between the catch member 39 and the catch receiver 40 is facilitated by the bias or load applied to the actuator 26 by the drinking spout 14 through the engagement of the bearing surface 35 of the actuator 26 with the front surface 36 of the spout 14. That engagement tends to retain the cooperation between the catch member 39 and the catch receiver 40. For example, in FIG. 4, movement of the actuator 26 in a direction to disconnect the catch member 39 from the catch receiver 40 will cause the bearing surface 35 of the actuator 26 to engage the neck 16 of the spout 14 and to prevent disconnection.

In FIG. 5, a push force has been applied to the push face 27 of the actuator 26 to cause the actuator 26 to slide inwardly relative to the inner lid 20 and the outer lid 21. The push force would ordinarily be applied by the thumb of a person wanting to drink from the drink bottle 10, although of course any finger can be used to apply pressure, or alternatively, pressure could be applied by different means if finger pressure is not available.

In FIG. 5, the inward movement of the actuator 26 has shifted the catch member 39 from cooperation with the catch receiver 40. Moreover, the inward movement of the actuator 26 has shifted the bearing surface 35 inwardly against the surface 36 of the drinking spout 14, and that movement of the actuator 26 has caused visible deformation of the neck 16. That resilient deformation of the drinking spout 14 is such as to increase the biasing load applied to the actuator 26 through the bearing surface 35, tending to push the actuator 26 back to the home position.

As a result of the catch member 39 being displaced from the catch receiver 40, the outer lid 21 is free to pivot about the hinge 22 to an open position as shown in FIG. 6. That pivoting movement can either be manually achieved by the person using the drink bottle 10 lifting the outer lid 21, or alternatively, the resilient recovery of the drinking portion 17 of the drinking spout 14 from the collapsed condition of FIGS. 4 and 5 will force the outer lid 21 to open in the absence of a force or load retaining the outer lid 21 in the closed position. In practice, if there is no load tending to maintain the outer lid 21 in the closed position, as soon as the lateral catch member 39 is free of the catch receiver 40, the outer lid 21 will spring open under the resilient recovery of the drinking portion 17 and the drinking portion will present for use as shown in FIG. 6.

The applicant has developed different actuators that have different constructions. A first form of actuator 26 has already been described in relation to FIG. 3. That actuator 26 has a push face 27, a bearing surface formed at the end 35, and an upstanding catch 38 upstanding from the body 41. The body 41 is a single part component and the sides of the body 41 are at least partially captured in grooves, slots or channels formed in the internal surfaces of the lid to guide the actuator during sliding travel between the home and actuation positions. Two different forms of actuator that are different in construction to the actuator 26 are shown in FIGS. 7*a*-7*d* and 8*a* to 8*d*.

Figure 7C:
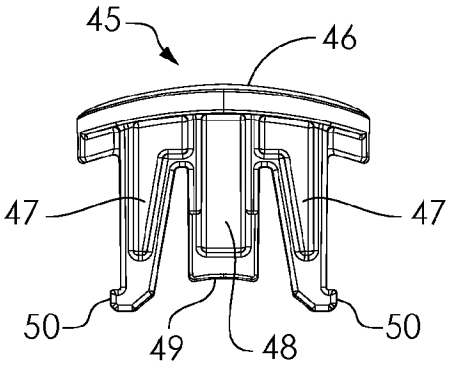
FIG. 7*c* is a plan bottom view of the actuator of FIGS. 7*a* and 7*b*.
Figure 7B:
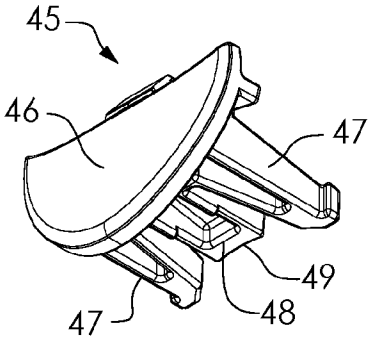
FIGS. 7*a* and 7*b* are perspective views of an actuator for use in a drink bottle according to the invention, taken from above and below.
Figure 7A:
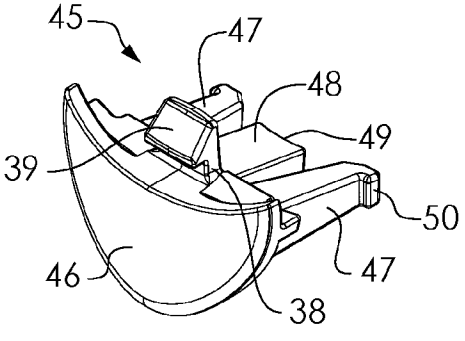

The actuator 45 shown in FIGS. 7*a* to 7*b* is equivalent to the actuator 26 shown in FIGS. 1 and 2, and includes a push face 46, a pair of side legs 47 and a central body 48. Remote from the push face 46, the central body 48 includes a convexly curved free end 49 for engagement with the front surface 36 of the neck 16 of the drinking spout 14.

Figure 7E:
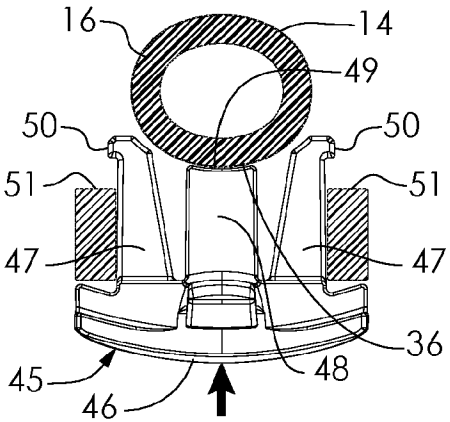
FIGS. 7*d* and 7*e* are plan top views showing the actuator of FIGS. 7*a* and 7*b* in use between the home and actuation positions.
Figure 7D:
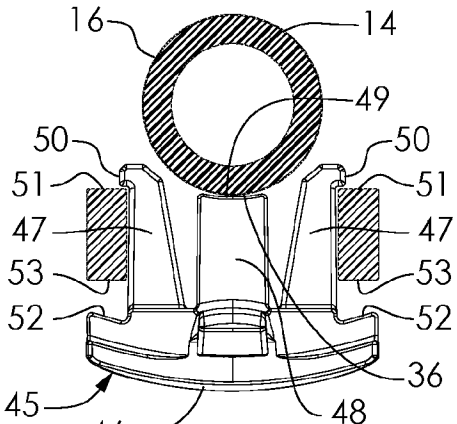

Also remote from the push face 46, are laterally extending abutments 50 which, as shown in FIGS. 7*d* and 7*e* extend laterally to overlie abutment surfaces 51 of the inner lid 20. In this respect, portions of the side legs 47 are captured within channels formed internally of the inner lid 20 to guide sliding movement of the actuator 45 between home and actuation positions. The abutments 50 are not captured within those channels and therefore bear against end surfaces (the abutment surfaces 51 of the channels) when the actuator 45 is in the home position as shown in FIG. 7*d*. Moreover, the actuator 45 includes a lip 52 adjacent the push face 46 that faces opposite abutment surfaces 53 of the inner lid 20 and thus it will be readily evident from FIGS. 7*d* and 7*e*, that the actuator 45 has limited travel between respective engagement between the abutment 50 and the abutment surfaces 51, and the lip 52 and the abutment surface 53.

FIGS. 7*d* and 7*e* also show the interaction or cooperation of the body 48 and the neck 16 of the drinking spout 14. In FIG. 7*d*, the actuator 45 is in the home position and so the lip 52 is in engagement with the abutment surfaces 53. The abutments 50 are spaced from the abutment surfaces 51. The neck 16 is cylindrical and relatively undeformed by any pressing contact with the bearing surface 49 of the body 48. That is, in the home position, there is only light engagement between the bearing surface 49 and the neck 16, and so the natural cylindrical configuration of the neck is largely undisturbed. However, in FIG. 7*e*, the actuator 45 has been pushed inwardly, so that now, the actuator 45 is in the actuation position and so the lip 52 is spaced from the abutment surfaces 53 and the abutments 50 have engaged the abutment surfaces 51. By that engagement, further inward travel of the actuator 45 is terminated.

The inward travel of the actuator 45 has also caused resilient deformation of the neck 16 so that the neck 16 is no longer cylindrical. The neck is biasing the actuator 45 towards the home position against the pushing force being applied to the actuator 45.

FIGS. 7*d* and 7*e* also show that the side legs 47 need to flex inwardly so that the abutments 50 can pass through the channels the inner lid 20 in which the side legs 47 are captured for sliding movement, given that the abutments 50 extend laterally a greater distance than the side surfaces 55 side legs 47. Thus, to insert the side legs 47 into the channels, the side legs 47 flex inwardly from a relaxed or resting position and once inserted, the side legs 47 return to the relaxed or resting position with the abutments 50 in facing relationship with the abutment surfaces 51. By this arrangement, the actuator 47 is captured in place in the lid 20 for limited sliding movement.

FIGS. 8*a* to 8*e* show an alternative actuator 55 which includes a push face 56 and a pair of legs 57. The free ends 58 and 59 of the legs 57 form a bearing surface for bearing against the front surface 36 of the neck 16 of the drinking spout 14 of the earlier figures. Abutments 60 are formed at the free ends of each of the legs 57 and a catch 62 is provided, having the same shape as the catch 38.

Figure 8C:
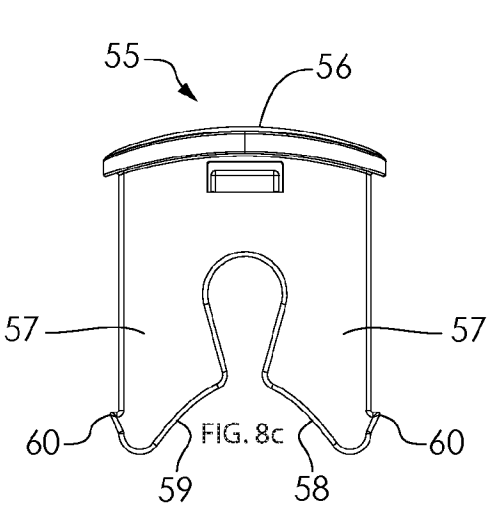
FIG. 8*c* is a plan bottom view of the actuator of FIGS. 8*a* and 8*b*.
Figure 8B:
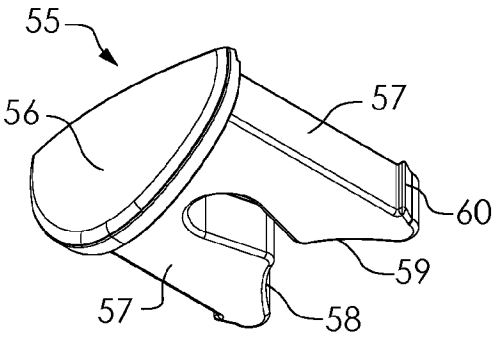
FIGS. 8*a* and 8*b* are perspective views of an actuator for use in a drink bottle according to the invention, taken from above and below.
Figure 8A:
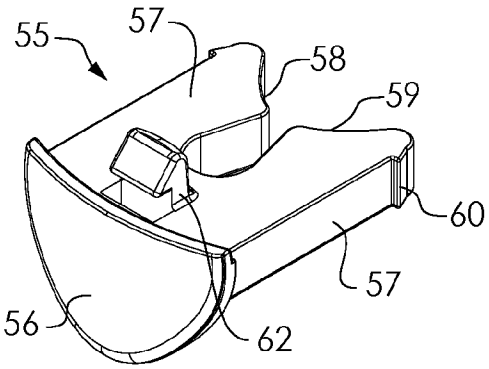

It will be evident from FIGS. 8*a* to 8*c*, that the actuator 55 has a different shape to the actuator 45 of FIGS. 7*a* to 7*c*. Despite this, the actuator 55 operates effectively in the same manner to the actuator 45. In FIG. 8*d*, the actuator 55 is in the home position, in which the abutments 60 bear against the abutment surfaces 61 of the inner lid 20. Like the side legs 47 of the actuator 45, the legs 57 are captured within channels formed internally of the lid 20 to guide sliding movement of the actuator between the home and actuation positions.

The actuator 55 is biased to the home position by bearing engagement with the neck 16 of the drinking spout 14. This occurs through bearing engagement between the bearing surfaces 58 and 59 of the legs 57 and a facing surface of the neck 16.

Figure 8E:
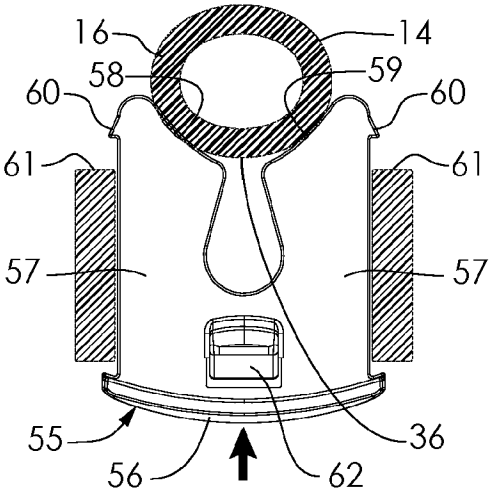
FIGS. 8*d* and 8*e* are plan top views showing the actuator of FIGS. 8*a* and 8*b* in use between the home and actuation positions.
Figure 8D:
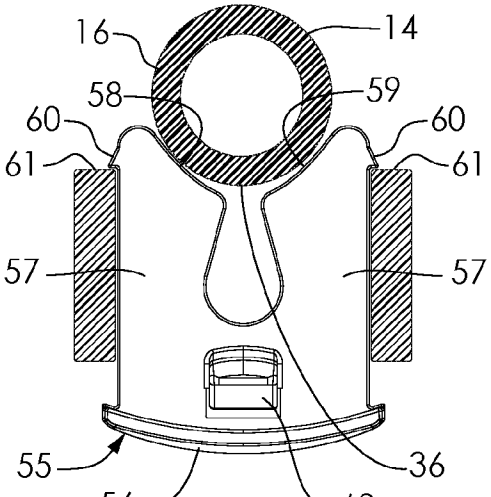

The actuator 55 can be pushed inwardly as shown in FIG. 8*e* by finger pressure applied to the push face 56 to displace the abutments 60 from the abutment surfaces 61. This inward movement deforms the neck 16 as shown in FIG. 8*e* and increases the biasing influence of the neck 16 on the actuator 55.

The actuator 55 operates substantially the same as the actuator 45, except that the actuator 55 does not include a lip 52 for engagement with an abutment face 53 as shown in FIGS. 7*d* and 7*e*. In contrast, inward movement of the actuator 55 is limited by abutting engagement between upstanding abutment 63 and an internal abutment of the inner lid 20.

Figure 9:
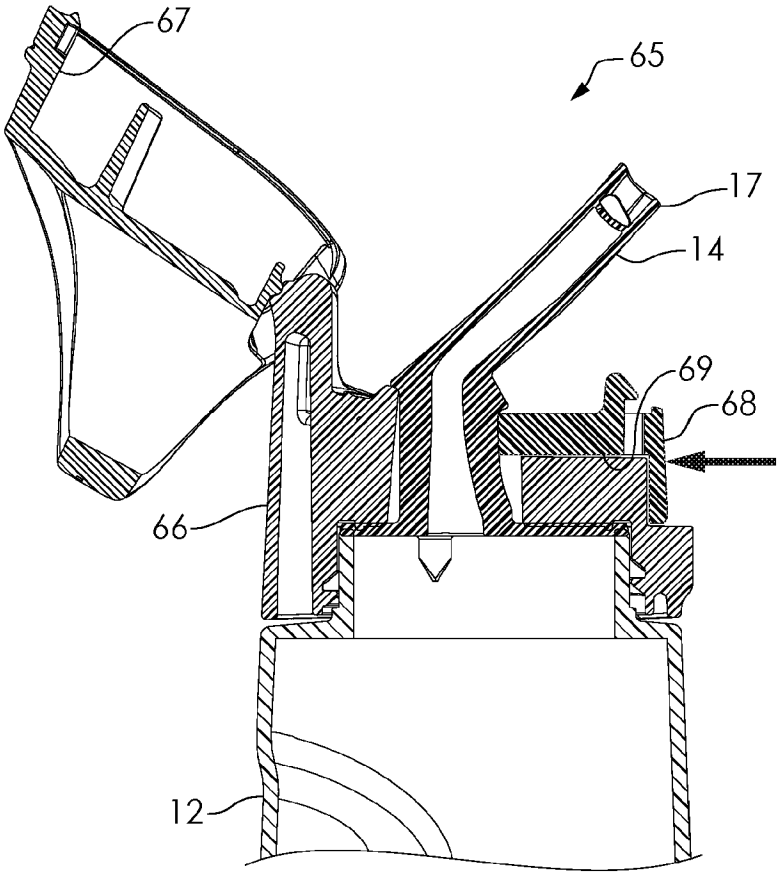
FIG. 9 is a cross-sectional view of a further form of lid for use in the invention, with the outer lid in an open position.

A further alternative form of drink bottle is illustrated in FIG. 9. FIG. 9 shows an arrangement in which a lid 65 is attached to the container 12 and includes an inner lid 66 and an outer lid 67. The inner lid 66 accommodates the same drinking spout 14 as previously described. The main difference between the inner lid 66 and the inner lid 20 previously described is that the inner lid 66 does not include an opening for accommodating the actuator 68. In FIG. 9, it can be seen that the inner lid 66 includes a bottom surface 69 on which the actuator 68 slides, but does not include an upper surface over the top of the actuator 68 in accordance with the opening 30 of the inner lid 20. Sides of the actuator 68 would still be at least partially captured in grooves, slots or channels formed in the internal surfaces of the lid to guide the actuator during sliding travel between the home and actuation positions.

The drink bottles illustrated in the figures all incorporate an actuator for actuating a function of a drink bottle, in which the specific function of the figures is to retain an outer lid connected to an inner lid in the closed condition, or to release the outer lid from the inner lid in the open condition. Critical to that function is that the actuator has a bearing surface in bearing engagement with the spout or straw assembly of the drink bottle, such that movement of the actuator from the home position towards the actuation position resiliently deforms the spout or straw assembly and by the resilient deformation the actuator is biased towards the home position. This critical feature of the drink bottle of the figures is common to all forms of the present invention. This feature is considered to provide advantages in relation to reductions in the complexity of drink bottles.

Where any or all of the terms "comprise", "comprises", "comprised" or "comprising" are used in this specification (including the claims) they are to be interpreted as specifying the presence of the stated features, integers, steps or components, but not precluding the presence of one or more other features, integers, steps or components.

Those skilled in the art will appreciate that the invention described herein is susceptible to variations and modifications other than those specifically described. It is understood that the invention includes all such variations and modifications which fall within the spirit and scope of the present invention.

The invention claimed is:

1. A drink bottle comprising:

a container for containing a liquid and a removable lid, the container having an open end and the removable lid being removably connected to the open end, the removable lid comprising an inner lid and an outer lid, the outer lid being shiftable relative to the inner lid between a closed position and an open position;

a drinking spout or straw assembly mounted in the removable lid for extraction of liquid from within the container through a resiliently flexible drinking spout or straw of the drinking spout or straw assembly; and an actuator slidably mounted to the inner lid for sliding movement between a home position and an actuation position, the actuator having a push face accessible from outside the removable lid for receiving finger pressure for displacing the actuator from the home position toward the actuation position, the actuator cooperating with the outer lid in the closed position of the outer lid to retain the outer lid in the closed position and movement of the actuator from the home position to the actuation position releasing that cooperation so that the outer lid is released to shift to the open position, the actuator having a bearing surface in bearing engagement with the drinking spout or straw assembly such that movement of the actuator from the home position towards the actuation position resiliently deforms the drinking spout or straw assembly and the actuator is biased towards the home position by the resilient deformation, and upper and lower ends of the push face slide in a same direction as the bearing surface when the actuator moves between the home position and the actuation position.

2. The drink bottle according to claim 1, wherein the outer lid is connected to the inner lid by a hinge.

3. The drink bottle according to claim 1, wherein the actuator is mounted or accommodated by the inner lid and the push face presents at or through a side wall of the inner lid.

4. The drink bottle according to claim 1, wherein the actuator is mounted or accommodated within an opening in the inner lid and the push face presents at or through a side wall of the inner lid.

5. The drink bottle according to claim 4, wherein the opening in the inner lid is a close or snug fit about the actuator so that the actuator is guided within the opening in the inner lid between the home and actuation positions.

6. The drink bottle according to claim 1, wherein the actuator has the push face at one end and the bearing surface at an opposite end, and wherein the bearing surface of the actuator is positioned between the drinking spout or straw assembly and the push face of the actuator.

7. The drink bottle according to claim 6, wherein the actuator has a lengthwise axis between the push face and the bearing surface and being mounted in the inner lid for linear movement along the lengthwise axis.

8. The drink bottle according to claim 1, further comprising a catch arrangement in which the actuator and the outer lid each include catch components which engage and cooperate when the outer lid is in the closed position to prevent movement of the outer lid to the open position.

9. The drink bottle according to claim 8, wherein the catch arrangement includes a catch that is formed as part of the actuator and a catch receiver that is formed as part of the outer lid, the catch and the catch receiver cooperating when the outer lid in the closed position to retain the outer lid in the closed position.

10. The drink bottle according to claim 9, wherein the catch is upstanding from a surface of the actuator and including a lateral catch member and the catch receiver comprising an opening or detent for receiving the lateral catch member.

11. The drink bottle according to claim 9, wherein at least one of the lateral catch member or the catch receiver has an inclined or sloping surface so that the respective members can ride past each other prior to the catch member being received within the catch receiver.

12. The drink bottle according to claim 1, wherein the actuator includes one or more abutments for terminating travel of the actuator at the home position.

13. The drink bottle according to claim 12, wherein the actuator includes a pair of abutments which extend in different directions for engagement with different abutment surfaces of the inner lid, to terminate travel of the actuator at the home position.

14. The drink bottle according to claim 13, wherein the pair of abutments extends in opposite directions.

15. The drink bottle according to claim 13, wherein the pair of abutments is provided remote from the push face.

16. The drink bottle according to claim 1, wherein the actuator has a depending body that has the bearing surface formed at a portion of the depending body remote from the push face.

17. The drink bottle according to claim 16, wherein the bearing surface is slightly curved convexly.

18. The drink bottle according to claim 1, wherein the actuator has a pair of legs that are spaced apart, the legs extending generally in a same direction and away from the push face.

19. The drink bottle according to claim 18, wherein one or each of the legs includes at least a portion of the bearing surface for bearing engagement with the drinking spout or straw assembly.

20. The drink bottle according to claim 1, wherein the actuator has a pair of side legs and an intermediate body between the side legs, the side legs and the intermediate body extending generally in a same direction and away from the push face.

21. The drink bottle according to claim 20, wherein the intermediate body is central between the side legs.

* * * * *